US005079048A

United States Patent [19]

Anitole

[11] Patent Number: 5,079,048

[45] Date of Patent: Jan. 7, 1992

[54] CAMOUFLAGE AUMENTATION DEVICE AND METHOD

[75] Inventor: George Anitole, Arlington, Va.

[73] Assignee: The United States of America as represented by the Secretary of the Army, Washington, D.C.

[21] Appl. No.: 629,082

[22] Filed: Dec. 19, 1990

Related U.S. Application Data

[63] Continuation of Ser. No. 421,027, Oct. 13, 1989, abandoned.

[51] Int. Cl.[5] ..... F41H 3/00

[52] U.S. Cl. ..... 428/17; 156/61; 428/99; 428/919

[58] Field of Search ..... 428/17, 99, 919; 156/61

[56] References Cited

U.S. PATENT DOCUMENTS

| | | | |
|---|---|---|---|
| 3,849,802 | 11/1974 | Govaars | 2/81 |
| 3,967,026 | 6/1976 | Dalblom | 428/919 X |
| 4,001,827 | 1/1977 | Wallin et al. | 428/919 X |
| 4,347,284 | 8/1982 | Tsutomu et al. | 428/919 X |
| 4,469,745 | 9/1984 | Robicci | 428/919 X |
| 4,560,608 | 12/1985 | Pusch et al. | 428/919 X |
| 4,580,372 | 4/1986 | Osborn | 428/192 X |
| 4,659,602 | 4/1987 | Birch | 428/919 X |
| 4,943,475 | 7/1990 | Baker et al. | 428/421 X |
| 5,024,594 | 6/1991 | Athayde et al. | 428/447 X |

FOREIGN PATENT DOCUMENTS

| | | | |
|---|---|---|---|
| 902767 | 8/1962 | United Kingdom | 428/919 |

*Primary Examiner*—Henry F. Epstein
*Attorney, Agent, or Firm*—Anthony T. Lane; Charles D. Miller

[57] ABSTRACT

A device and method for camouflaging an object or terrain by use of a white U.V. reflectance material to which has been applied an appropriate terrain configuration by paint indicating partial snow coverage, desert, or woodland designs. The material may be placed above, onto, beside, against and or secured thereto at different heights and may be extended in different sloping angles for an offset appearance.

14 Claims, 6 Drawing Sheets

CAMOUFLAGE AUMENTATION DEVICE AND METHOD

STATEMENT OF GOVERNMENT INTEREST

The invention described herein may be manufactured and used by or for the United States Government for governmental purposes without payment of any royalties therefor or thereon.

This application is a continuation of application Ser. No. 07/421,027, filed 10/13/89 is now abandoned.

BACKGROUND OF THE INVENTION

This invention is directed to a device for camouflaging military equipment in different types of terrain, including partial snow and snow covered areas, desert, and woodland backgrounds. It can be used on vehicles of all types, camouflage nets, tarpaulins, tents, airplanes, gun emplacements, fighting positions, and other ground areas. It may be used to conceal vehicle tracks, wheels, wheel wells and undercarriages of vehicles, reflection from windshields, black holes, open vehicle cargo areas, etc.

PRIOR ART

Snow camouflage is not adequate to provide concealment where snowfall is less than complete or snow cover is transitory. The snow camouflage net is designed for arctic or sub-arctic conditions and is bulky and cumbersome to carry requiring a white support system in addition to the woodland net and separated support system when both verdant and snow conditions exist concurrently or in rapid sequence.

Military vehicles have been painted in camouflage patterns of different shades of color to enable blending with the background. Such camouflaging left exposed, the wheels and wheel wells, permitted reflection of the sun from the windshield and windows and the body shapes were obvious. It is therefore obvious that many parts of a vehicle were not camouflaged, and where there is partial snow coverage, a complete white coverage was a sure give-away.

In the prior art, suggestions have been made to use adhesive backed white patches which may be randomly placed on a dark colored vehicle or which may cover the existing pattern outlines for snow camouflage.

It is therefore an object of this invention to provide a camouflage material which is lightweight, economical and which can be used for many different camouflage situations.

Another object is to provide a camouflage material which enables one to camouflage various objects to their various surroundings with regard to shape, general brightness, and color tone.

Still another object is to provide a camouflage material which can be used to camouflage vehicle bodies, wheels, wheel wells, windows, windshields and camouflage nets and truck tarpaulins. Different types of terrain can be duplicated.

Yet another object is to provide a material which has an inherent high ultraviolet reflectance for camouflage in snow areas.

The invention will be better understood and further objects and advantages thereof will become more apparent from the ensuing detailed description of a preferred embodiment, taken in conjunction with the drawings.

DETAILED DESCRIPTION

This invention makes use of a sheet of white material which has a high ultraviolet reflectance from both surfaces of the sheet in which the reflectance is similar to the reflectivity of snow. The material does not require an addition of zirconium oxide to reflect in the ultraviolet such as found in U.S. Pat. No. 4,347,284. It has been found that a white sheet of TYVEK, a tradename of Dupont, which is a spin-bonded polyethylene fiber formed into a non-woven fabric satisfies the ultraviolet requirement. Such a material has a very small water absorption, it is long lasting and of lightweight. TYVEK weighs about 1.20 ounces per square yard.

Therefore, in military use for example, a kit of twelve 5'×8' sheets could be carried by a person without too much difficulty. For a completely covered snow enviroment the TYVEK sheet can be used to cover any desired object since the sheet is normally white.

Figure 1:
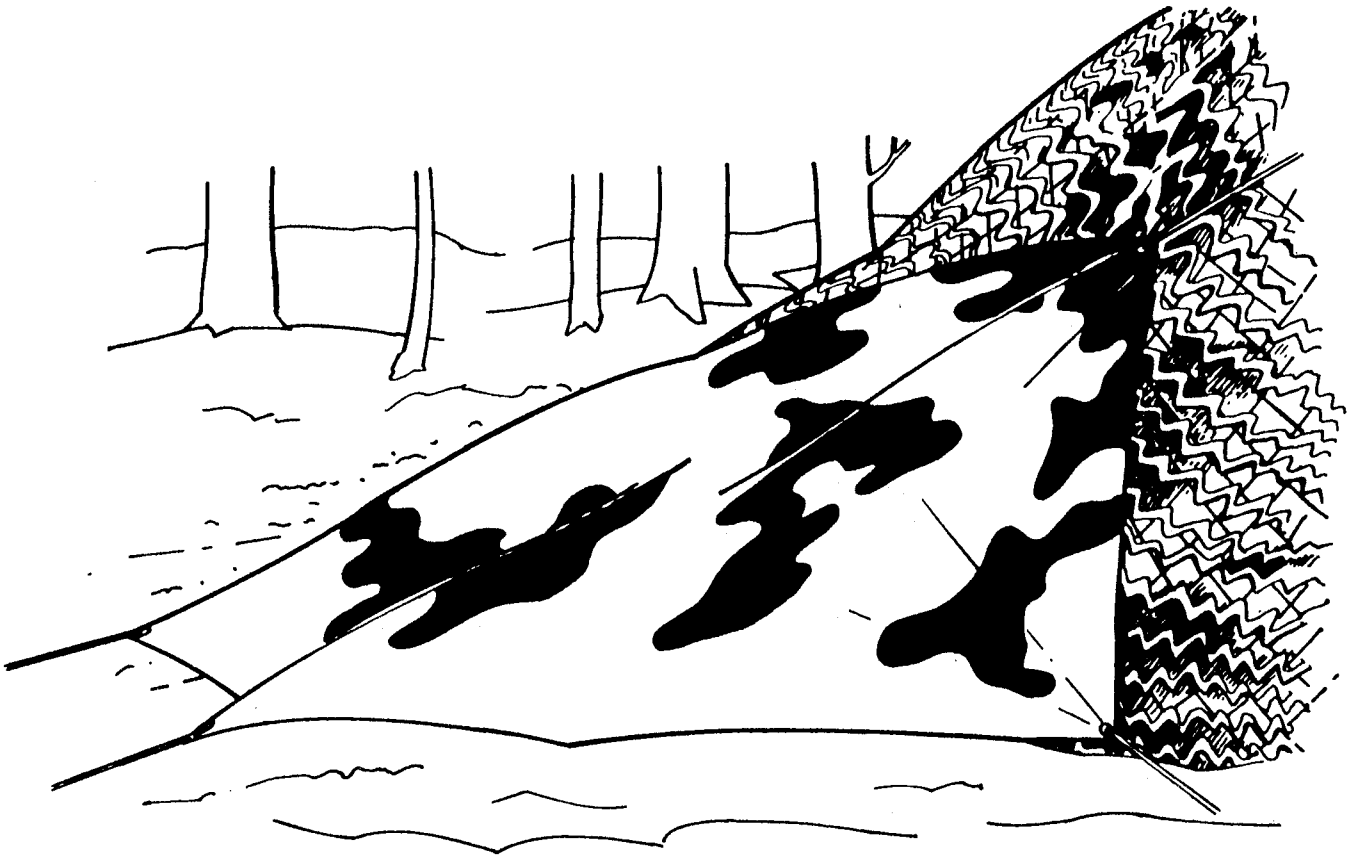
FIGS. 1 and 2 illustrate a partial snow covered camouflage area with the camouflage material over a woodland camouflage net which could cover a gun implacement or any other military object.
Figure 2:
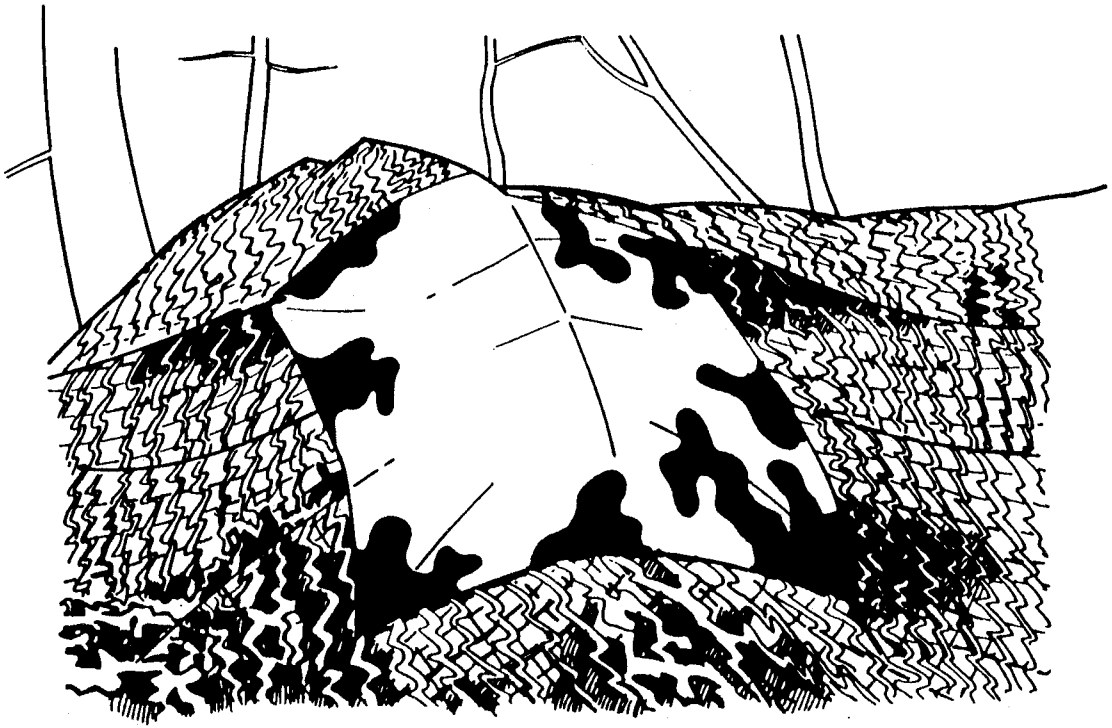

For partially covered snow area, irregularly shaped snow areas, as shown in FIGS. 1 and 2, are painted out on each sheet of TYVEK with black printing ink or latex paint. The corners and edges of the sheets are colored out to break up the rectangular outline and only the desired white shapes appear as snow. Different snow shaped patterns may be made on opposite sides of each sheet, resulting in two different pattern shapes per sheet. The specific design shapes may be based on an examination of photos of actual broken snow backgrounds.

Figure 3:
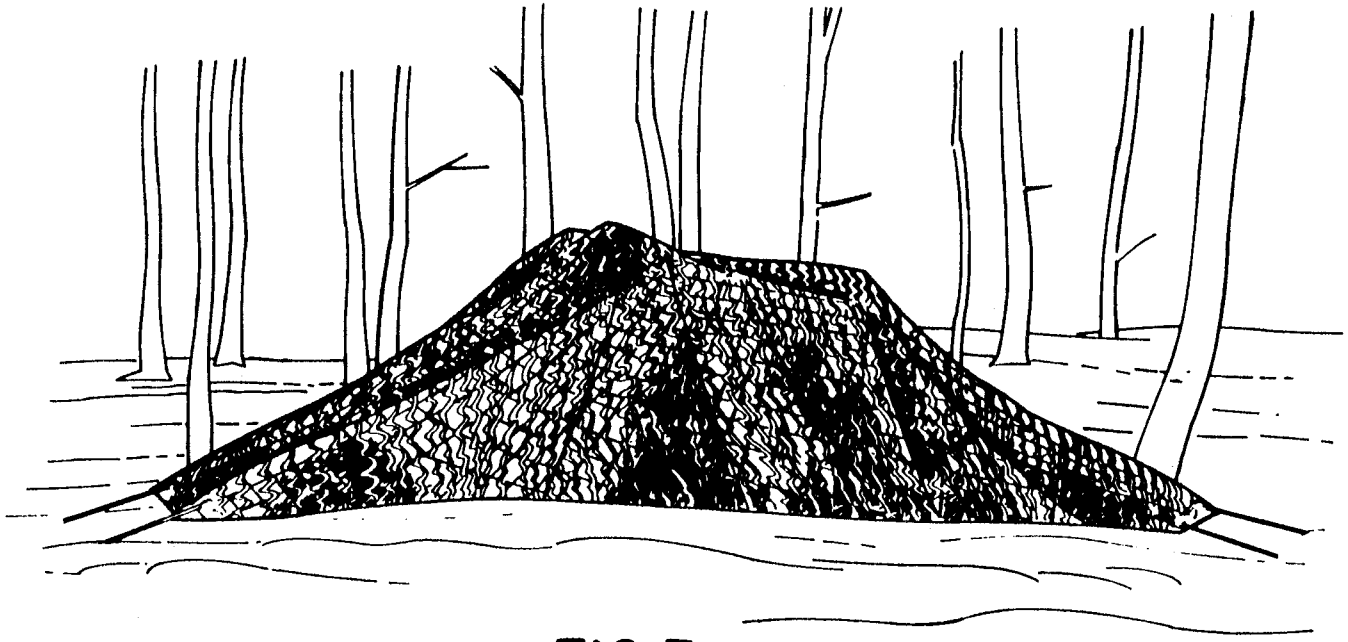
FIGS. 3 and 4 are distant views of an uncamouflaged and camouflaged area, respectively.
Figure 4:
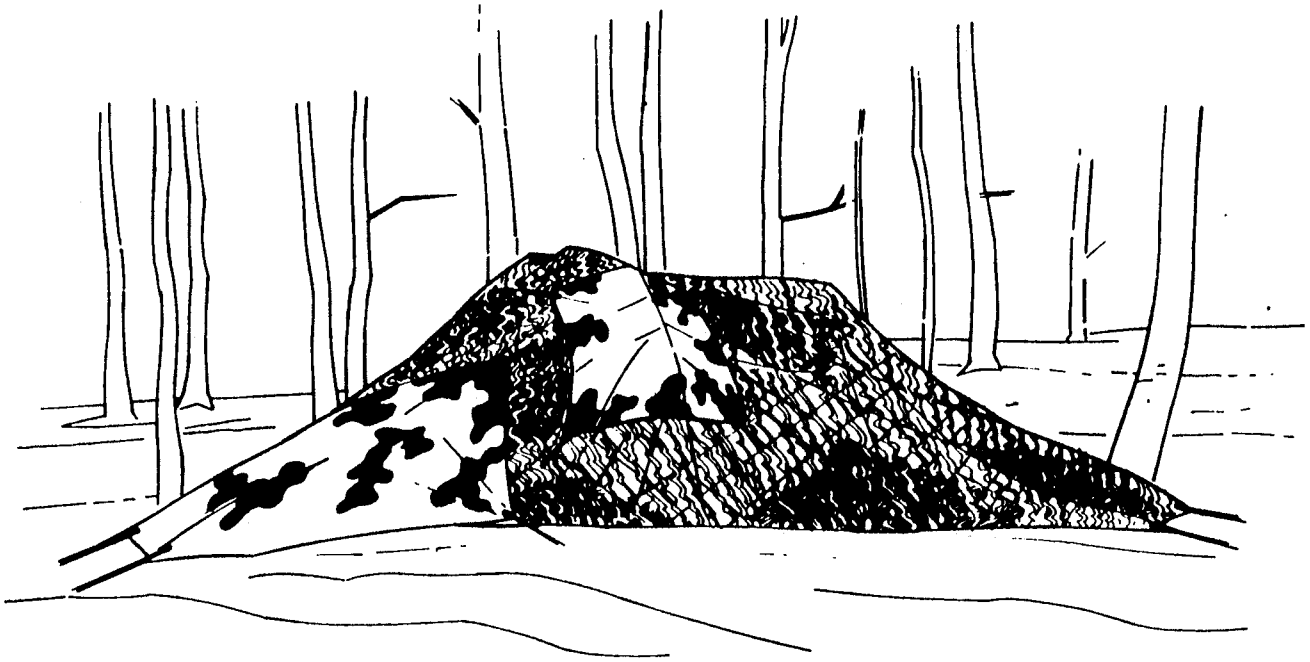

FIGS. 3 and 4 clearly show the effectiveness of the invention on the woodland camouflage net. In FIG. 3, one's attention would be readily drawn to the camouflage net but in FIG. 4, the attached snow camouflage material blends the camouflaged net into the background.

As shown in FIGS. 6*a* to 6*g*, numerous designs for the camouflage sheets are envisioned to cover a variety of possible areas, devices or things to be protected. It is quite obvious that the numerous tie downs generated by unusual shapes will compound the efforts required in setting up and taking down the camouflage sheets, but a most desirable approach to resolving these drawbacks lies in utilizing a square or rectangularly shaped sheet with the desired design painted thereon.

The use of rectangular shapes make it easier to secure the TYVEK sheets since only the corners need to be tied down, whereas if irregular shaped snow patches were cut out, a tie down would be needed for each cut-out flap to prevent flopping down and blowing in the wind. In addition, irregular shapes would limit the total number of shapes in the kit as compared to rectangular sheets with different snow shapes on each side. For example, a dozen sheets can be packed into a camouflage net repair kit bag providing 24 different snow shapes for tailoring the camouflage to any specific broken snow environment. The snow patch sheets are attached to the equipment via cords passed through grommets attached to each corner of the sheet. The cords are tied to equipment protrusions, holes, shapes,-pegs, etc., with the idea of continuing the actual broken snow areas on the ground around the base of the equipment onto the equipment, keeping in mind the relative ratio of snow areas to open ground areas. The photos shown in FIGS. 1 and 2 show a close-up of snow patches and views of a net with and without snow patches. This system contemplates the joining of a plurality of camouflage sheets of any desired configuration or design and the sheets may be overlapped to achieve larger camouflage patterns. TYVEK sheets painted to include snow patches can be used over textile materials (tents, trucktarps) and can effectively conceal vehicle tracks, wheels, wheel wells, and undercarriages when tied to the vehicles and staked or draped to the ground. The use of snow patches for vehicles will provide more effective camouflage than the use of paint on the vehicles since the amount of white and dark areas on the sheets can be tailored to match the background, whereas painted vehicles whether all white or patterned painted with white paint have a set pattern or color. In addition, wheel wells, tires or tracks are still very visible on painted vehicles. The adhesive backed white plastic patches which have been previously suggested and experimentally tested for vehicle camouflage, can only be applied to flat, clean surfaces, and if left on too long are difficult to removed. They may also be difficult to apply and adhere to cold, wet surfaces.

In addition to camouflage of equipment as described above, the snow patches may also be used to conceal gun implacements, turrets of dug-in vehicles, other weapons sites, and even individual positions. They also provide a weather shield. They may be used as ground patches to help conceal tracks, captured material, and equipment when viewed from the air and to create a better blend with a camouflaged item of equipment by doctoring up the snow background.

Figure 5:
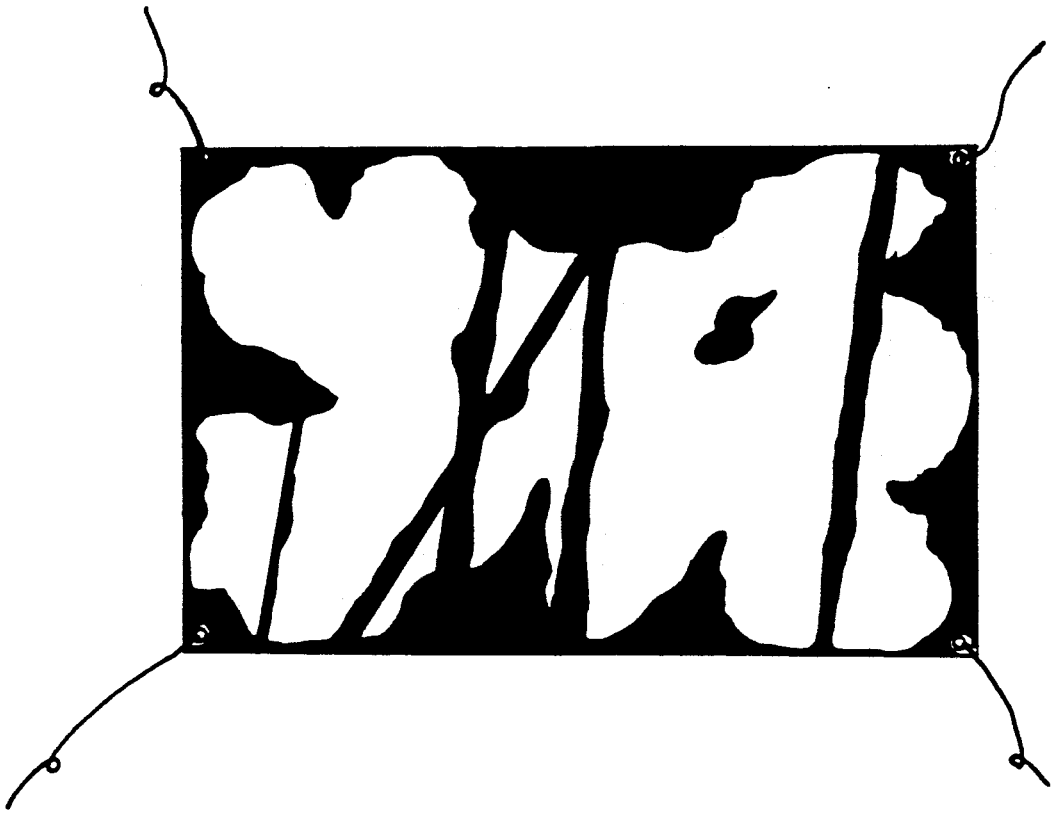
FIG. 5 shows a camouflage sheet including leafless small trees and samplings.
Figure 6A:
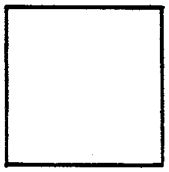
FIGS. 6*a* to 6*g* show various shapes of sheets as examples of versatility of camouflaging.
Figure 6B:
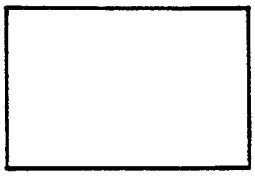
Figure 6C:
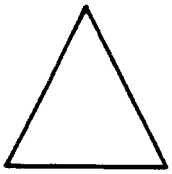
Figure 6D:
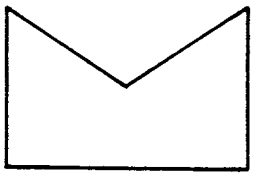
Figure 6E:
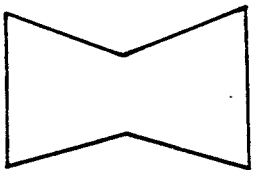
Figure 6F:
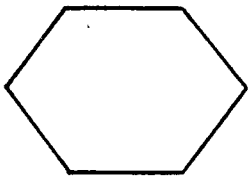
Figure 6G:
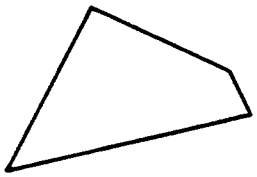

In addition to painting out irregular shaped snow areas on edges and corners of TYVEK sheets, one or two straight up and down lines of various widths can be painted on the sheet to help blend in with leafless small trees and saplings found in wooded areas during the winter, as seen in FIG. 5.

TYVEK sheets also have important application in the desert. For example, the dominant factors in detecting camouflaged vehicles in desert backgrounds from a ground position are the undercarriage shadow, wheel wells, and tires or wheels. These conspicuous signature cues are detectable from great distances even if the color of the body of the vehicle blends well with the background. Desert colored sheets of TYVEK (either monotone or patterned to match the vehicle depending upon the background) can be tied to the vehicle and staked obliquely to the ground. It would not be necessary to paint out the edges and corners to conceal these signatures. Such is also applicable to a 100% snow environment where a vehicle is all white in which case unpainted TYVEK can serve the same purpose to camouflage the wheels and wheel wells. Desert colored sheets, either monotone or patterned depending on background, can be used over monotone green colored tents or truck tarpaulins when used in desert areas. This is particularly important since most tarpaulins will be monotone green even though the vehicle body may be desert colored.

When viewed from the air, the most conspicuous signature of a vehicle particularly in desert or snow environments is its shadow. TYVEK sheets (either patterned or monotone as the background dictates) can be used to break up the shadow. The sheets can be tied to the vehicle and sloped in different directions to create an irregular shadow which does not attract the eye of an airborned observer.

In woodland areas, TYVEK sheets painted in the standard 3-color woodland colors and pattern can be used to conceal vehicle undercarriages wheel wells, and tires or wheels. They can also be used to camouflage monotone truck tarpaulins and tents. A truck tarpaulin in most cases presents a larger target than the body of the vehicle itself and would negate any camouflage effect a patterned vehicle body would have.

Since TYVEK sheets are used which have been painted for the particular situation or in the case of complete snow coverage left as is, such sheets could be rolled into a spring roll such as a window shade and attached to different parts of a vehicle, tank, gun mount, etc. Thus, when the device is stationary and requires a camouflage situation, the sheets could be easily unrolled to provide the camouflage coverage. The rolls could be applied at different heights to provide a broken situation.

It will be obvious that sheets of TYVEK may be colored and or painted to represent any desired enviroment and can be used in any desired situation requiring camouflage. The sheets may be placed on top of or along side any desired object.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method of camouflage in a partial snow covered area which comprises:

forming at least one sheet of ultraviolet reflective white spun-bonded polyethylene material into a desired configuration, which includes a plurality of corners for anchoring the material;

blacking-out different areas of a first surface of said sheet;

forming the different blacked-out areas into different shaped patterns representative of partial and non-snow covered areas; and placing at least one so-formed sheet in an area desired to be camouflaged.

2. A method as set forth in claim 1, which includes:

forming different patterns on a second or reverse surface of said sheet in which the painted patterns are different from the patterns on the first side thereof, whereby, the specific blacked-out pattern designs are based upon examination of actual broken snow backgrounds.

3. A method as set forth in claim 2, in which:

said sheet of material is formed with a plurality of only linear straight line edges thereby avoiding arcuate shapes, and the blacked-out areas on said first and second surfaces include most of said corners of said sheet.

4. A method as set forth in claim 3, which comprises:

forming grommets at each corner of said sheet.

5. A method as set forth in claim 2, which comprises:

forming grommets at least at said corners of said sheet to receive tied down ropes.

6. A method as set forth in claim 2, in which:

said pattern includes at least two parallel black strips of varying widths which extend from one edge to another edge.

7. A method as set forth in claim 1, which comprises:

forming grommets at least at said corners of said sheet to receive tied down ropes.

8. A camouflage device which comprises:

a sheet of ultraviolet reflective white spun-bonded polyethylene material;

different patterns of blacked-out areas on a first surface of said sheet of material.

9. A camouflage device as set forth in claim 8, in which:

a second surface of said white sheet includes different patterns of blacked-out areas in which the patterns of blacked-out areas are different from said blacked-out areas on said first surface.

10. A camouflage device as set forth in claim 9, which includes:

a rectangular sheet of material in which the different patterns of blacked-out areas include the surface areas at each corner of each of said first and second surfaces of said sheet.

11. A camouflage device as set forth in claim 10, in which:

each said sheet is provided with hold-down grommets at each corner.

12. A camouflage device as set forth in claim 9, in which:

each said sheet is provided with hold-down grommets at each corner.

13. A camouflage device as set forth in claim 8, in which:

each said sheet is provided with hold-down grommets at each corner.

14. A camouflage system which comprises:

A sheet of white spun-bonded polyethylene fiber material with inherently high ultraviolet reflectance said material having substantially all edges darkened with a color other than white and having various other regions darkened with said color other than white in irregular patterns.

* * * * *